US006170607B1

(12) United States Patent
Freeman et al.

(10) Patent No.: US 6,170,607 B1
(45) **Date of Patent: *Jan. 9, 2001**

(54) ELECTRICAL HAZARD WARNING SYSTEM FOR AERIAL DEVICES

(75) Inventors: Michael J. Freeman, Canton, MI (US); William J. Baker, St. Joseph, MO (US)

(73) Assignee: Altec Industries, Inc., Birmingham, AL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/108,650

(22) Filed: Jul. 1, 1998

(51) Int. Cl.[7] ..... E06C 5/34; E04G 1/00
(52) U.S. Cl. ..... 182/18; 182/2.1
(58) Field of Search ..... 182/2.3, 2.4, 2.8, 182/18, 19, 46, 63.1, 69.6; 324/72, 133, 509, 522, 555, 693, 713, 722; 340/661, 685

(56) References Cited

U.S. PATENT DOCUMENTS 3,136,385 * 6/1964 Eitel ..... 182/2.4
3,168,729 * 2/1965 Volberg ..... 340/685 X
3,320,524 * 5/1967 Miller, Jr. ..... 182/2.4 X
3,786,468 * 1/1974 Moffitt ..... 340/685 X
4,553,632 * 11/1985 Griffiths ..... 182/2.4
4,676,340 * 6/1987 Correll, Jr. ..... 182/2.4
4,679,653 * 7/1987 Pasquarette, Jr. et al. ..... 182/2.4
4,727,447 * 2/1988 Rome ..... 340/685 X
5,001,465 * 3/1991 Siegel ..... 340/685
5,268,591 * 12/1993 Fujimoto ..... 182/2.4 X
5,296,844 * 3/1994 Hanrahan et al. ..... 340/661 X
5,313,165 * 5/1994 Brokaw ..... 340/661 X
5,416,470 * 5/1995 Tanaka et al. ..... 340/661 X

* cited by examiner

*Primary Examiner*—Daniel P. Stodola
*Assistant Examiner*—Hugh B. Thompson
(74) *Attorney, Agent, or Firm*—Shook, Hardy & Bacon LLP

(57) ABSTRACT

A warning system for an aerial device which provides an alarm signal when a worker on an aerial work platform is exposed to an electrical hazard. The aerial device has an insulated boom which carries the work platform on its upper end. An electrostatic charge is introduced to all conductive components near the platform. The electrostatic charge is harmless to the worker and dissipates upon contact with an energized power line or grounded object. The absence of charge is then sensed by a warning device which provides an alarm signal.

24 Claims, 3 Drawing Sheets

ELECTRICAL HAZARD WARNING SYSTEM FOR AERIAL DEVICES

FIELD OF THE INVENTION

This invention relates generally to the field of aerial devices of the type commonly used for work on power lines. More particularly, the invention is directed to a system for providing workers with a warning of the existence of dangerous electrical conditions during use of an aerial boom in proximity to overhead electrical lines.

BACKGROUND OF THE INVENTION

Aerial devices are used to carry out a number of different types of jobs, including many types of work in the electrical utility industry. The aerial device includes a vehicle mounted boom having a personnel carrying platform on its end. The boom can rotate on the vehicle bed and can pivot up and down in order to position the platform advantageously for the work that is to be done. The boom typically includes multiple sections which can be connected for articulation about an elbow joint or for telescopic extension and retraction.

A common use of aerial devices in the electric utility industry involves work in close proximity to overhead power lines which are energized at high voltage levels. For safety, the boom is typically constructed of fiberglass in order to electrically isolate the platform area from the ground. On multiple section booms such as an articulating boom assembly having upper and lower booms, the upper boom is commonly constructed of fiberglass and the lower boom commonly has a fiberglass insert. The base end of the boom at the vehicle chassis, the elbow joint between the two booms, and the platform area all have metal components that are electrically conductive. The chassis can be grounded to keep the base end of the boom safety in a grounded condition. The insulated booms serve to isolate the elbow joint and particularly the platform from the ground so that a circuit path to ground is not presented along the boom.

Under prevailing industry standards, workers at the platform working on power lines at 47 Kv or less are considered to be primarily protected by wearing insulated rubber gloves or using insulated "hot sticks" in conjunction with work practices that incorporate minimum recommended approach distances to the power lines. The insulated boom is considered to be secondary or back up protection for these workers. However, as a practical matter, workers do not always follow these recognized safety practices.

If standard safety practices are not followed, there are several ways in which personnel in an aerial platform can be exposed to electrical dangers. For example, a worker who is not wearing gloves or using a hot stick can contact two different electrical phases or one phase and a grounded object, thus completing a circuit through his body. This type of incident does not involve the aerial device at all and can be avoided through the use of proper safety techniques.

If the boom should lose the dielectric integrity which provides its insulating properties, a conductive path is created from the platform through the boom to the ground, thus endangering personnel on the platform as well as those on the ground. Inspection and maintenance practices and periodic testing are currently used to minimize the likelihood of the boom loosing its insulating properties.

Under some conditions, the platform can loose its electrical isolation from the ground even though the boom insulation is effective. There are a number of metal components typically present on the platform, including control handles for the hydraulic valves and various metal brackets and other hardware. Any of the metal components can unintentionally come into contact with an energized conductor or a grounded object such as a ground wire, a guy wire, or even a pole or tree. If a worker who is not wearing gloves and who touches a grounded object happens at the same time to contact a metal part that is in contact with an energized power line, a circuit is completed through his body without any platform movement. Similarly, even when the platform is stationary, an unprotected worker may grasp an energized conductor and inadvertently touch a metal part that is in contact with a grounded object.

A different type of hazardous situation results when an operator moves the platform while he is in contact with an energized conductor or a grounded object, and the platform moves to where a grounded object or a power line contacts a metal part of the boom tip such as a control handle the worker is using. Again, a circuit path is completed through the body of the worker, this time as a result of platform movement Cranes and similar devices have been equipped with alarm systems to warn against electrical hazards. Typically, these devices use proximity sensors to detect when the boom structure is near a power line. Some systems even deactivate the boom if the electrical field exceeds a predetermined level. This type of equipment is constructed using conductive booms, so if a power line is contacted, it is too late to take corrective action because a ground path has already been created through the boom. Consequently, the warning system gives an alarm when a power line is being approached and before it is actually contacted. This type of alarm system is useless with an aerial device because the intent is to work in close proximity to energize power lines. No purpose is served by providing a warning signal because the workers already know they are near power lines and they intend to be there.

SUMMARY OF THE INVENTION

The present invention is directed to a warning system for an aerial device which provides an alarm signal when a hazardous situation exists due to metal components of the work platform contacting an energized power line or a grounded object.

It is a primary object of the invention to provide a system which operates reliably to warn of a situation involving the work platform losing its electrical isolation and thereby exposing workers to an electrical hazard. The invention is characterized by the ability to provide a warning when an unprotected worker is subjected to conditions where the danger of exposure to high voltage is present.

In accordance with the invention, a warning system operates to subject the work platform of an aerial device to a static potential which has a high voltage level and a low current limitation so that the applied voltage is harmless to personnel on the platform. Minute current leakage along the boom is measured so that the insulation of the boom is constantly monitored to assure its continued integrity. At the same time, contact between metal components at the platform and an energized power line or a grounded object which negates the electrical isolation of the platform is detected, and an alarm signal is generated to warn the workers of the dangerous condition that exists. As a result, the danger can be eliminated and the safety of the equipment is enhanced accordingly.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
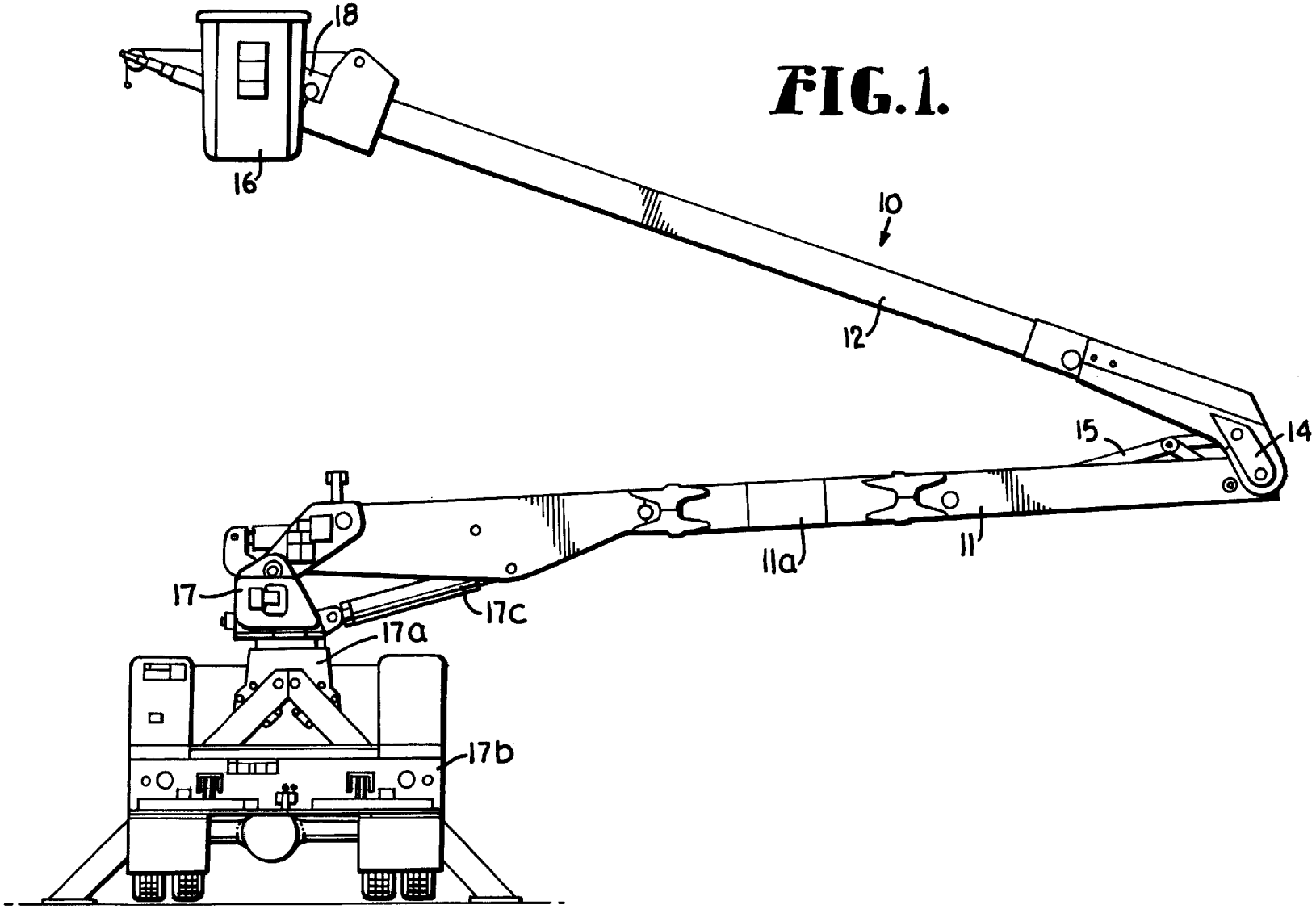
FIG. 1 is a diagrammatic elevational view of an aerial device having an articulating boom of the type that may be equipped with an electrical hazard warning system constructed in accordance with the present invention.

Referring now to the drawings in more detail and initially to FIG. 1, numeral 10 generally designates a boom assembly of the type commonly incorporated in vehicle mounted aerial devices. The boom assembly 10 may include a lower boom 11 and an upper boom 12 both of which are elongated structures connected together for relative pivotal movement at a metal elbow 14. A hydraulic cylinder 15 may be used to pivot the upper boom 12 relative to the lower boom 11. The upper boom 12 terminates at a tip end of the boom assembly which carries a platform 16. The platform 16 may take the form of a bucket in which one or more workers can be stationed to perform various types of work.

The base end of the lower boom 11 is connected with a turret 17 which is mounted to rotate about a vertical axis on a pedestal 17*a* or other support structure in the bed of a utility vehicle 17*b*. The turret 17, pedestal 17*a* and the chassis of the vehicle 17*b* are constructed of metal and are electrically connected. When the machine is in use, the chassis of the vehicle 17*b* must be grounded by standard means. The lower boom 11 can be pivoted up and down about a horizontal axis passing through its base end. A hydraulic cylinder 17*c* serves to pivot the lower boom up and down in order to assist in situating the work platform 16 in an advantageous position for performing work on overhead power lines and other elevated structures.

Figure 2:
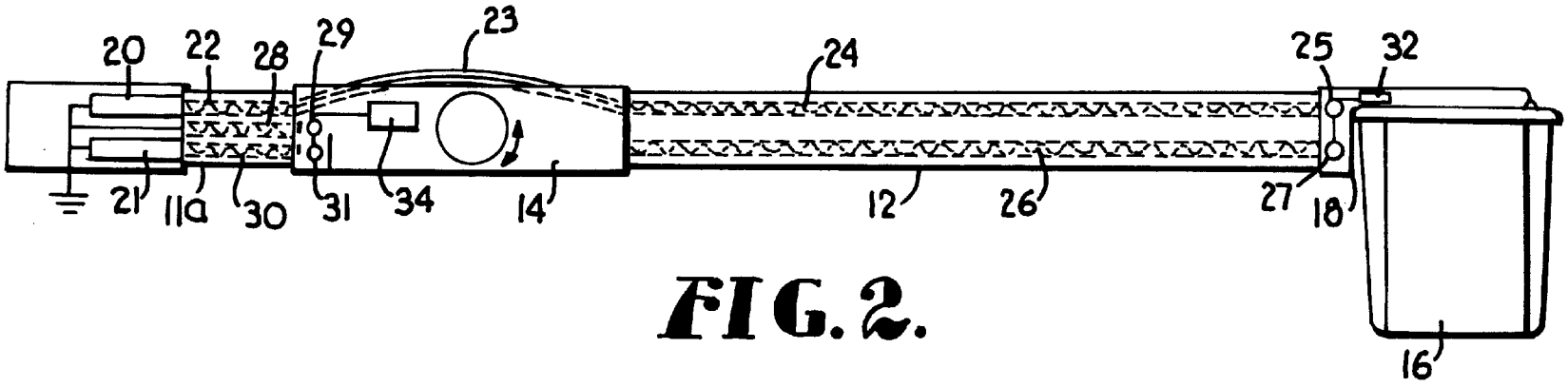
FIG. 2 is a diagrammatic side elevational view showing the insulated upper boom and platform of FIG. 1 equipped with an electrical hazard warning system constructed according to one embodiment of the present invention.

The platform 16 typically has various metal components which are collectively designated by numeral 18 in FIGS. 1 and 2. The metal components 18 may include control handles for valves used to control the hydraulic system which rotates the boom 12 and pivots it up and down. The metal components 18 may additionally include various metal brackets and other hardware secured to the platform 16 or at another portion of the tip end of the upper boom 12.

In order to provide safety when workers on the platform 16 are working on energized power lines, the boom assembly 10 is electrically insulated. Typically, the upper boom 12 is constructed of fiberglass and the lower boom 11 is equipped with a fiberglass insert 11*a* which provides electrical insulation. Due to the insulated nature of the boom, the workers stationed on the platform 16 are isolated from the ground so that they are protected against completion of an electrical circuit through their bodies to the ground when they work on energized power lines.

Figure 3:
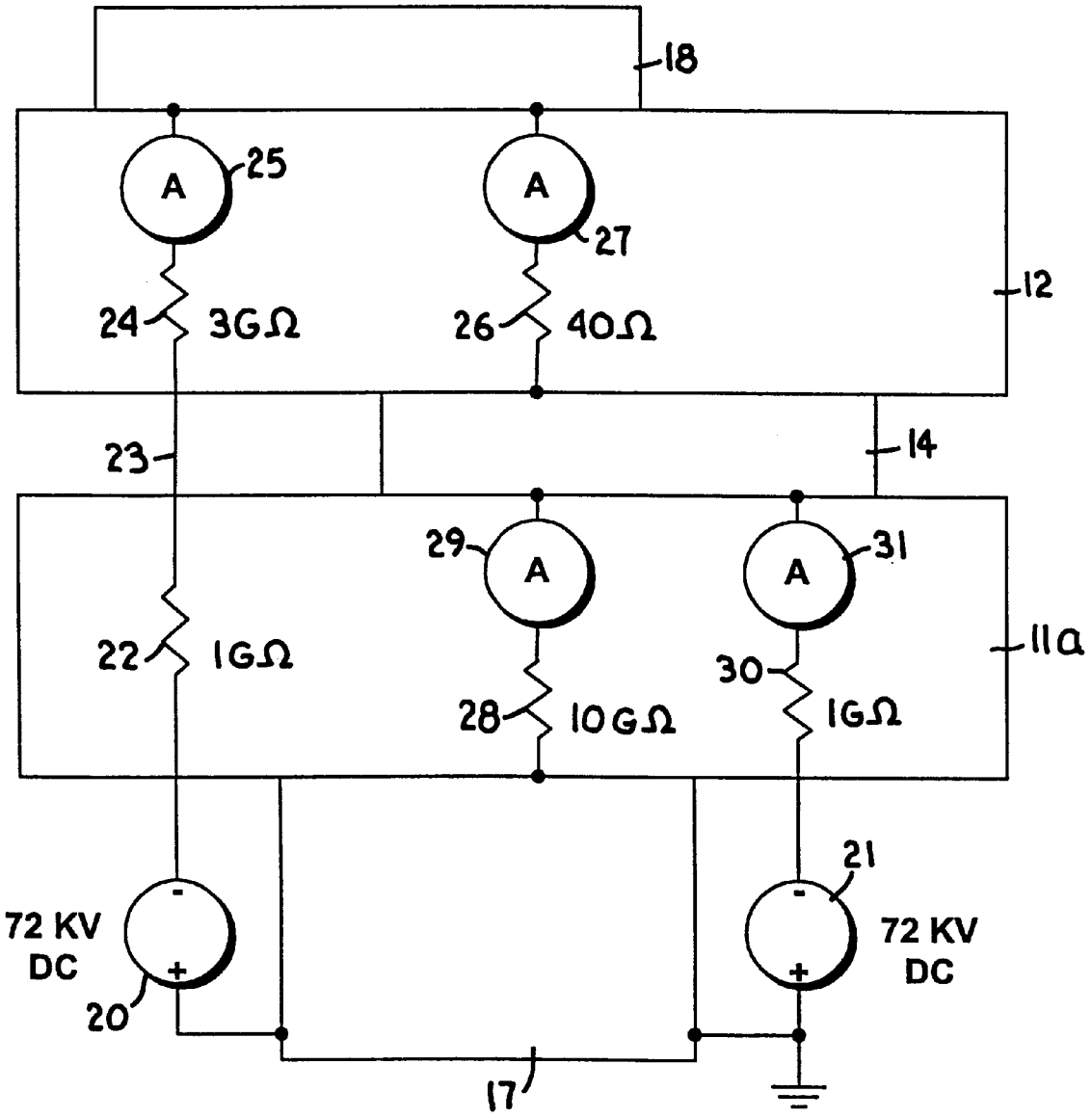
FIG. 3 is a schematic diagram of the electrical circuitry of the warning system shown in FIG. 2.

In accordance with the present invention, and as shown in FIGS. 2 and 3, the base of the boom is equipped with a pair of high voltage power supplies 20 and 21. Preferably, the power supplies are direct current supplies having built in current limiting and output voltage monitoring capabilities. Suitable solid state power supplies are commercially available up to approximately 80 KV. This type of power supply is well known and is based on a step up transformer and a rectifying multi-stage diode-capacitor voltage multiplier network.

An encapsulated high impedance element 22 is connected with the power supply 20 and extends within or along the lower boom insert 11*a* from the base end of the boom. Element 22 connects through a flexible insulated conductor 23 with another high impedance element 24. The conductor 23 has sufficient slack to accommodate relative pivotal movement between the upper and lower booms 11 and 12 about the elbow joint 14. Element 24 extends along or within the upper boom 12 to connection with the metal components 18 at the platform end of the boom. All metal components associated with the platform 16 or otherwise present at the tip end of the boom are electrically connected together such as by extending conductor wires between them. Consequently, all of the metal components 18 are maintained at a common static high voltage level by the power supply 20 supplying the high potential through the high impedance elements 22 and 24 and the flexible conductor 23. Because of the high impedance of elements 22 and 24, the current flow through them is extremely low. The current limiting character of the power supply 20 also assures that the current flow is always limited to a minute level. A current meter 25 is connected in the circuit between element 24 and the metal components 18.

Another encapsulated high impedance element 26 is connected with the elbow 14 and extends within or along the upper boom 12 to connection with the metal components 18 at the platform end of the boom. Element 26 is arranged in series with the combined element formed by series connected elements 22 and 24 and provides a redundant means for verifying the current flow through element 22 and 24 as measured by current meter 25. To this end, a current meter 27 is connected between element 26 and the metal components 18.

Another encapsulated high impedance element 28 is connected to extend along or within the lower boom insert 11*a* between the elbow 14 and the turret 17 (FIG. 1) or other metal component at the base end of the boom assembly.

The second power supply 21 connects with a high impedance element 30 which extends along or within the lower boom insert 11*a* and connects with the elbow 14. A current meter 31 is connected between element 30 and the elbow 14. A current meter 29 connects between element 28 and the elbow 14. The power supplies 20 and 21 are arranged such that the voltages they apply are opposite in polarity, as shown in FIG. 3. Thus, power supply 20 is shown connected to apply a positive voltage to the metal components 18 while power supply 21 applies a negative voltage to the elbow 14.

The high impedance elements may have a variety of electrical impedance values, provided that the impedances are sufficient to limit the current levels to values that are low enough to assure safety. The elements are encapsulated in a good dielectric material such as high density polyethylene which prevents leakage laterally from the elements to other electrically conductive objects. In the preferred embodiment of the invention, the high impedance elements are resistive in nature and have break down voltage ratings in excess of 50,000 volts per foot.

By way of example, the high resistance elements can be constructed by placing a number of precision high impedance, high voltage resistors in series. By using resistors that are of equal value and by equally spacing them apart, the parasitic capacitance of each resistor is approximately equal, and both direct current and time varying voltage applied to the chains of resistors are equally divided along the resistors in the chain. Thus, the voltage rating of a single resistor can be multiplied by the total number of resistors in the chain. There are a number of commercially available precision high voltage, high impedance resistors that are suitable for use in the present invention.

The current measuring devices may be of any type suitable to accurately measure small current levels. The devices 25 and 27 are redundant and thus enhance reliability. Devices 29 and 31 are also redundant.

A signal processing and warning device 32 is connected with the current measuring devices 25 and 27. The device 32 can be set with a predetermined alarm trip point which activates a warning signal when the current measured by device 25 or 27 deviates from a selected level. Another signal processing and warning device 34 is connected with the current meters 29 and 31.

By way of example, the warning device 32 can be set to provide an alarm signal when the upper boom 12 leakage current exceeds the current leakage which is allowed under industry standards. Current ANSI standards specify that a 47 KV rated aerial device upper boom is required to be insulated sufficiently to allow leakage current of no more than 28 micro amps at a DC test voltage of 56 KV. The power supply voltage levels and high impedance element resistance values shown in FIG. 3 would lead to a combined current of 15.4 micro amps through the high impedance elements with 56 KV applied across the upper boom. Thus, instead of the 28 micro amps that is normally allowed at 56 KV to meet the ANSI standards, a boom equipped with a warning system of the present invention as depicted in FIG. 3 would pass the standard ANSI test only if the leakage current through the boom itself is 12.6 micro amps or less. The controlled leakage of 15.4 micro amps through the high impedance elements added to the 12.6 micro amps permitted through the boom adds up to the 28 micro amps that are permitted by the ANSI standards at 56 KV.

The device 32 provides a warning signal whenever the total current leakage through the boom exceeds the prevailing standard. Thus, the operator is alerted to a loss of insulation effectiveness in the boom and can take whatever corrective action is necessary. It is a fundamental aspect of the invention that the high impedance elements present controlled leakage paths along the boom. However, the controlled leakage levels that are introduced by equipping the boom with the high impedance elements depend upon the values chosen for the voltage of the power supplies and the resistance of the high impedance elements. These variables are limited by practical considerations of cost and size, but they can be varied from the values given without departing from the present invention.

In operation, the warning system provides an alarm generated by device 32 whenever the insulating properties of the boom drop below what is considered to be a safe level. The alarm signal may be audible, visual or both, and it may include voice commands as well as other alarms.

If the boom is positioned such that the metal components 18 come into contact with an energized AC power line or an earth grounded object, a hazardous situation is presented because a worker on the platform 16 working without insulated gloves may touch an energized conductor or a grounded object with one hand and one of the metal components 18 with the other hand. However, if the metal components 18 are in contact with a high voltage wire, the current flow through the current meter 25 is increased well above the trip point of the alarm device 32, and the alarm then generates a warning signal alerting the workers to the fact that one of the metal components is in contact with an energized conductor creating a dangerous situation. If the metal components 18 are in contact with an earth grounded object, the current flow through meter 25 is increased above the trip point of the alarm 32, again providing an alarm signal. In either situation, the operator is alerted to the dangerous situation and can move the boom to displace the metal component 18 from the wire or grounded object in order to resume safe operation.

Both of the dangerous situations described above occur even though the platform is stationary. A different but equally dangerous situation can arise through movement of the platform while a worker not wearing protective gloves is in contact with an energized conductor or an earth grounded object. If the worker holding the control handle which is one of the metal components 18 then moves the platform to where any of the components 18 contacts a grounded object or an energized conductor, a current path through the worker's body is established.

This situation is dealt with by the warning system of the present invention. When a gloveless worker has one hand on an energized conductor or a grounded object and his other hand on the control handle, his body creates a circuit path at a safely low current level that brings the voltage level of the metal components 18 to the level of the energized conductor or grounded object. This causes the alarm 32 to generate a warning signal alerting the worker that he should not move the boom because to do so would be dangerous.

The current meters 29 and 31 operate similarly in conjunction with high impedance elements 28 and 30 and warning device 34 to monitor for a loss of insulating effectiveness of the lower boom insert 11*a* and for grounding or high energization of the elbow 14 caused by the elbow contacting a grounded object or an energized conductor. The signals that are generated by the alarm devices can be selected to provide an indication of what the exact problem is by generating a different signal (audio, voice and/or visual) for each meter when that meter is tripped.

In addition to the boom structure shown in FIGS. 1–3, some aerial devices have (usually short) lower booms that are constructed of metal and lack an insulating insert or of the telescopic design. The present invention is applicable to booms of that type, one of which is shown diagrammatically in FIG. 4. In the boom assembly 110 shown in FIG. 4, the upper boom 112 is the only insulated part of the boom assembly. Thus, from the elbow 114 on down, all of the parts are metal and electrically connected. The platform 116 is carried on the end of the upper boom and has electrically conductive components 118 which are collectively designated by numeral 118. All of the components 118 are electrically connected with each other.

A high voltage power supply 120 is provided on elbow 114 or somewhere below if desired. A high impedance element 124 extends from the power supply 120 along or within the upper boom 112 to connection with the metal components 118. A current meter 125 is connected between element 124 and the metal components 118. Another high impedance element 126 extends along the upper boom 112 from the elbow 114 to the metal components 118. A current meter 127 is connected between element 126 and the metal components 118. A signal processing and warning device 132 is connected with the current meters 125 and 127 and operates to generate an alarm signal when the total upper boom 112 leakage current exceeds a predetermined level (such as the prevailing ANSI standard).

Figure 4:
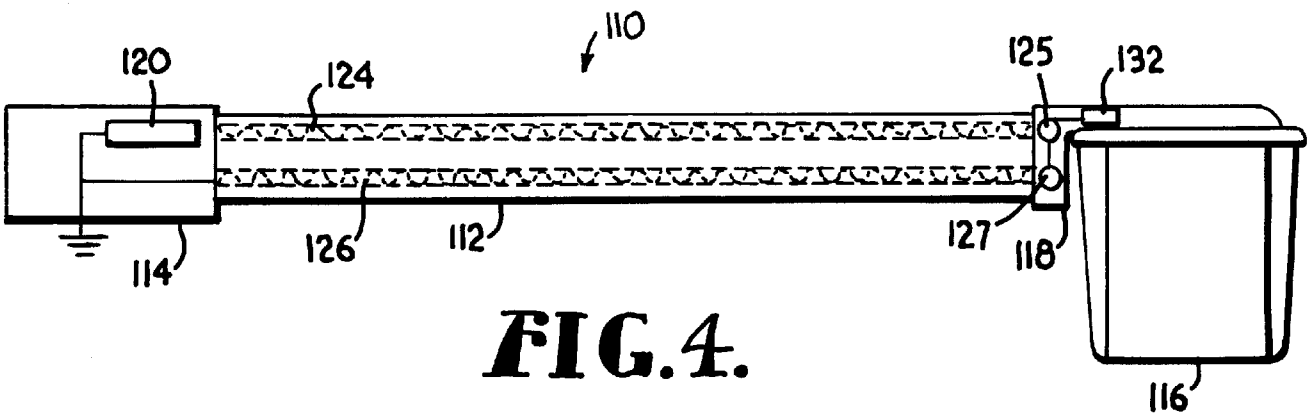
FIG. 4 is a diagrammatic elevational view of an upper boom and platform equipped with a warning system constructed in accordance with a different embodiment of the invention.

The embodiment shown in FIG. 4 operates in a manner similar to that described in connection with the embodiment of FIGS. 1–3. As previously described, when the metal components 118 are in contact with an energized conductor or a grounded object, the increased DC current flow is sensed by meter 125, and the warning device 132 then generates an alarm signal. Similarly, if an unprotected worker is in contact with an energized conductor or a grounded object and grasps the metal control handle for the boom motion control valves, the increased current is sensed and the warning device 132 provides an alarm signal alerting the worker that he should not move the platform. If the upper boom 112 loses its dielectric integrity, an alarm signal is also given to inform the operator that corrective action is necessary.

It should be understood that the current may decrease from a normal level under an unsafe condition, depending upon the location of the current measuring device. For example, the element 126 has a normal current flow (sensed by meter 127) that would drop to zero if the metal components 118 are contacted by a grounded object. In such circumstances, the short circuit created by the grounded object would cause the current to completely bypass element 126. Thus, meter 127 would sense a current that is reduced from its normal level. The embodiment shown in FIGS. 1–3 can similarly operate by sensing a current that is reduced from a normal level and generating an alarm in response to the reduced current. It is the deviation from a predetermined normal current that is sensed in accordance with the present invention to detect a dangerous condition and provide an alarm signal to alert workers of the danger.

From the foregoing it will be seen that this invention is one well adapted to attain all ends and objects hereinabove set forth together with the other advantages which are obvious and which are inherent to the system.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An aerial device comprising:

an elongated boom having a base end and a tip end and means for electrically insulating said tip end from said base end;

an aerial platform on the tip end of said boom for carrying personnel, said platform having an electrically conductive portion; and means for providing a warning signal when said conductive portion actually contacts an energized conductor or a grounded object, said means for providing a warning signal being ineffective to provide a warning signal when said conductive portion is near said energized conductor or a grounded object but not in actual contact therewith.

2. An aerial device as set forth in claim 1, including means for providing a warning signal in the event of a condition where personnel on the platform simultaneously contact said conductive portion and an energized conductor or a grounded object.

3. An aerial device as set forth in claim 1, wherein when said energized conductor comprises an overhead electric power line having a predetermined potential and said means for providing a warning signal comprises:

means for applying a selected electrical potential to said conductive portion of the platform, said selected potential being different from the predetermined potential of said energized conductor;

means for sensing when said conductive portion is subjected to a potential which deviates from said selected potential due to contact with said energized conductor or a grounded object; and means for providing an alarm signal in response to sensing of a deviant potential.

4. An aerial device as set forth in claim 1, wherein said means for providing a warning signal comprises:

a high voltage power supply;

a first high impedance element extending from said power supply along the boom to said conductive portion of the platform;

a second high impedance element extending back along the boom from said conductive portion to said power supply to complete an electrical circuit and maintain said conductive portion of the platform at a high voltage level, said first and second elements being characterized by high impedance values sufficient to maintain the platform in a substantially electrically insulated condition;

means for sensing the current flow along at least one of said elements; and means for providing an alarm signal when the sensed current deviates from a predetermined value.

5. An aerial device as set forth in claim 1, wherein:

said boom includes upper and lower electrically insulated boom sections connected together for relative pivotal movement at an elbow joint having an electrically conductive component.

6. An aerial device as set forth in claim 5, including means for providing a warning signal in the event of a condition where personnel on the platform simultaneously contact said conductive portion and an energized conductor or a grounded object.

7. An aerial device as set forth in claim 5, wherein when said energized conductor comprises an overhead electric power line having a predetermined potential and said means for providing a warning signal comprises:

means for applying a selected electrical potential to said conductive portion of the platform, said selected potential being different from the predetermined potential of said energized conductor;

means for sensing when said conductive portion is subjected to a potential which deviates from said selected potential due to contact with said energized conductor or a grounded object; and means for providing an alarm signal in response to sensing of a deviant potential.

8. An aerial device as set forth in claim 5, wherein said means for providing a warning signal comprises:

a high voltage power supply;

a first high impedance element extending from said power supply along the boom to said conductive portion of the platform;

a second high impedance element extending back along the boom from said conductive portion to said power supply to complete an electrical circuit and maintain said conductive portion of the platform at a high voltage level, said first and second elements being characterized by high impedance values sufficient to maintain the platform in a substantially electrically insulated condition and one of said elements including a flexible portion bypassing and insulated from said electrically conductive component of said elbow joint;

means for sensing the current flow along at least one of said elements; and means for providing a warning signal when the sensed current deviates from a predetermined value.

9. An aerial device as set forth in claim 5, including means for providing an alarm signal when said conductive component of the elbow joint contacts an energized conductor or a grounded object.

10. An aerial device as set forth in claim 9, wherein said means for providing an alarm signal comprises:

means for applying a selected electrical potential to said conductive component of the elbow joint;

means for sensing when said conductive component is subjected to a potential which deviates from said selected potential; and means for providing said alarm signal in response to sensing of a deviant potential.

11. An aerial device as set forth in claim 9, including a second high voltage power supply;

a second electrical circuit from said second power supply to said conductive component of the elbow joint and including high impedance elements maintaining said conductive component at a high voltage level and characterized by impedance values high enough to maintain said lower boom section in a substantially electrically insulated condition;

means for sensing the current flow in said second circuit; and means for providing an alarm signal when the current sensed in said second circuit deviates from a predetermined value.

12. An aerial device comprising:

an elongated boom having a base end and a tip end, said boom being electrically insulated;

an aerial platform carried on the tip end of said boom for holding a worker, said platform having an electrically conductive portion; and means for providing a warning signal in the event of a condition where a worker on said platform actually contacts said conductive portion and an energized conductor or a grounded object, said means for providing a warning signal being ineffective to provide a warning signal in the event of a condition where a worker on said platform is near to but not in actual contact with said energized conductor or a grounded object.

13. An aerial device as set forth in claim 12, including means for providing a warning signal when said conductive portion contacts an energized conductor or grounded object.

14. An aerial device as set forth in claim 12, wherein when said energized conductor comprises an overhead electric power line having a predetermined potential and said means for providing a warning signal comprises:

means for applying a selected electrical potential to said conductive portion of the platform, said selected potential being different from the potential of said energized conductor;

means for sensing when said conductive portion is subjected to a potential which deviates from said selected potential due to contact with said energized conductor or a grounded object; and means for providing an alarm signal in response to sensing of a deviant potential.

15. An aerial device as set forth in claim 12, wherein said means for providing a warning signal comprises:

a high voltage power supply;

a first high impedance element extending from said power supply along the boom to said conductive portion of the platform;

a second high impedance element extending back along the boom from said conductive portion to said power supply to complete an electrical circuit and maintain said conductive portion of the platform at a high voltage level, said first and second elements being characterized by high impedance values sufficient to maintain the platform in a substantially electrically insulated condition;

means for sensing the current flow along at least one of said elements; and means for providing an alarm signal when the sensed current deviates from a predetermined value.

16. An aerial device as set forth in claim 12, wherein:

said boom includes upper and lower electrically insulated boom sections connected together for relative pivotal movement at an elbow joint having an electrically conductive component; and said aerial device includes means for providing an alarm signal when said conductive component contacts an energized conductor or a grounded object.

17. An aerial device as set forth in claim 16, wherein said means for providing a warning signal comprises:

a high voltage power supply;

a first high impedance element extending from said power supply along the boom to said conductive portion of the platform;

a second high impedance element extending back along the boom from said conductive portion to said power supply to complete an electrical circuit and maintain said conductive portion of the platform at a high voltage level, said first and second elements being characterized by high impedance values sufficient to maintain the platform in a substantially electrically insulated condition and one of said elements including a flexible portion bypassing and insulated from said electrically conductive component of said elbow joint;

means for sensing the current flow along at least one of said elements; and means for providing a warning signal when the sensed current deviates from a predetermined value.

18. An aerial device as set forth in claim 17, wherein said means for providing an alarm signal comprises:

a second high voltage power supply;

a second electrical circuit from said second power supply to said conductive component of the elbow joint and including high impedance elements maintaining said conductive component at a high voltage level and characterized by impedance values high enough to maintain said lower boom section in a substantially electrically insulated condition;

means for sensing the current flow in said second circuit; and means for providing an alarm signal when the current sensed in said second circuit deviates from a predetermined value.

19. An aerial device comprising:

an elongated boom having a base end and a tip end;

an aerial platform on said tip end of the boom for carrying personnel;

means for normally electrically insulating said boom for the safety of personnel in the platform;

a voltage source located in proximity to the base end of said boom;

means for applying voltage at a selected electrical potential from said voltage source to said conductive portion of the platform along said boom in a manner to maintain the boom electrically insulated for the safety of personnel in the platform;

means for sensing when said conductive portion is subjected to a potential which deviates from said selected potential; and means for providing an alarm signal in response to sensing of a deviant potential.

20. An aerial device as set forth in claim 19, including an electrically conductive portion of said platform and wherein said means for providing an alarm signal comprises:

a high voltage power supply providing said voltage source;

a first high impedance element extending from said power supply along the boom to said conductive portion of the platform;

a second high impedance element extending back along the boom from said conductive portion to said power supply to complete an electrical circuit and maintain said conductive portion of the platform at said selected potential, said first and second elements being characterized by high impedance values sufficient to maintain the platform in a substantially electrically insulated condition;

means for sensing the current flow along at least one of said elements; and means for providing said alarm signal when the sensed current deviates from a predetermined value.

21. An aerial device as set forth in claim 19, wherein:

said platform has an electrically conductive portion;

said boom includes upper and lower boom sections connected together for relative pivotal movement at an elbow joint having an electrically conductive component;

said insulating means includes means for normally electrically insulating both said upper and lower boom sections; and said means for providing an alarm signal is operable to provide said alarm signal when said insulating means fails to insulate either boom section to a predetermined level of effectiveness.

22. An aerial device as set forth in claim 21, wherein said means for providing an alarm signal comprises:

a high voltage power supply providing said voltage source;

a first high impedance element extending from said power supply along the boom to said conductive portion of the platform;

a second high impedance element extending back along the boom from said conductive portion to said power supply to complete an electrical circuit and maintain said conductive portion of the platform at said selected potential, said first and second elements being characterized by high impedance values sufficient to maintain the platform in a substantially electrically insulated condition and one of said elements including a flexible portion bypassing and insulated from said electrically conductive component of said elbow joint;

means for sensing the current flow along at least one of said elements; and means for providing said alarm signal when the sensed current deviates from a predetermined value.

23. An aerial device as set forth in claim 22, including:

a second high voltage power supply;

a second electrical circuit from said second power supply to said conductive component of the elbow joint and including high impedance elements maintaining said conductive component at a high voltage level and characterized by impedance values high enough to maintain said lower boom section in a substantially electrically insulated condition;

means for sensing the current flow in said second circuit; and means for providing an alarm signal when the current sensed in said second circuit deviates from a predetermined value.

24. An aerial device comprising:

an elongated boom having a base end and a tip end, said boom including upper and lower sections connected together for relative pivotal movement at an elbow join having an electrically conductive component;

an aerial platform on said tip end of the boom for carrying personnel, said platform having an electrically conductive portion;

means for normally electrically insulating both the upper and lower sections of said boom for the safety of personnel in the platform;

a voltage source located in proximity to the base end of said boom;

means for applying voltage at a selected electrical potential from said voltage source to said conductive portion of the platform;

means for sensing when said conductive portion is subjected to a potential which deviates from said selected potential; and means for providing an alarm signal in response to sensing of a deviant potential, said means for providing an alarm signal being operable to provide said alarm signal when said insulating means fails to insulate either boom section to a predetermined level of effectiveness.

* * * * *

UNITED STATES PATENT AND TRADEMARK OFFICE

CERTIFICATE OF CORRECTION

PATENT NO. : 6,170,607 B1 
DATED : January 9, 2001
INVENTOR(S) : Michael J. Freeman and William J. Baker It is certified that error appears in the above-identified patent and that said Letters Patent is hereby corrected as shown below:

Drawings,
FIG. 3, at numeral 20, the "+" sign should be at the top and the "-" sign should be at the bottom.

Signed and Sealed this

Sixteenth Day of July, 2002

*Attest:*

*Attesting Officer*

JAMES E. ROGAN
*Director of the United States Patent and Trademark Office*